US008343327B2

(12) United States Patent
Weiner et al.

(10) Patent No.: US 8,343,327 B2
(45) Date of Patent: Jan. 1, 2013

(54) APPARATUS AND METHODS FOR FAST CHEMICAL ELECTRODEPOSITION FOR FABRICATION OF SOLAR CELLS

(75) Inventors: Kurt H. Weiner, San Jose, CA (US); Gaurav Verma, Sunnyvale, CA (US)

(73) Assignee: Reel Solar, Inc., San Jose, CA (US)

( * ) Notice: Subject to any disclaimer, the term of this patent is extended or adjusted under 35 U.S.C. 154(b) by 351 days.

(21) Appl. No.: 12/787,330

(22) Filed: May 25, 2010

(65) Prior Publication Data

US 2011/0290654 A1 Dec. 1, 2011

(51) Int. Cl.
*C25D 5/10* (2006.01)
*C25D 5/00* (2006.01)
*C25D 17/00* (2006.01)

(52) U.S. Cl. ..... 205/123; 205/118; 205/170

(58) Field of Classification Search ..... 205/91, 205/123, 118, 170

See application file for complete search history.

(56) References Cited

U.S. PATENT DOCUMENTS 3,949,463 A * 4/1976 Lindmayer et al. ..... 438/72
4,507,181 A * 3/1985 Nath et al. ..... 205/91
4,595,791 A * 6/1986 Basol et al. ..... 136/256
H274 H * 5/1987 Ruggerio ..... 257/774
4,816,120 A * 3/1989 Ondris et al. ..... 205/224
4,872,925 A * 10/1989 McMaster ..... 136/244
5,516,412 A 5/1996 Andricacos et al.
5,985,123 A 11/1999 Koon
6,071,388 A 6/2000 Uzoh
6,072,190 A * 6/2000 Watanabe et al. ..... 257/48
6,074,544 A 6/2000 Reid et al.
6,106,680 A * 8/2000 Nogami et al. ..... 204/280
6,132,587 A 10/2000 Jorné et al.
6,136,163 A 10/2000 Cheung et al.
6,156,167 A 12/2000 Patton et al.
6,159,354 A 12/2000 Contolini et al.
6,162,344 A 12/2000 Reid et al.
6,176,992 B1 1/2001 Talieh
6,217,734 B1 4/2001 Uzoh
6,793,796 B2 * 9/2004 Reid et al. ..... 205/102
7,666,008 B2 2/2010 Levante et al.
7,704,352 B2 4/2010 Lopatin et al.
2001/0035354 A1 11/2001 Ashjaee et al.

(Continued)

FOREIGN PATENT DOCUMENTS

JP 05-004213 1/1993
WO WO 2011/054037 5/2011

OTHER PUBLICATIONS

International Search Report for PCT/US2011/036339 mailed Dec. 20, 2011.

(Continued)

*Primary Examiner* — Keith Hendricks
*Assistant Examiner* — Stefanie Sherrill
(74) *Attorney, Agent, or Firm* — Kwan & Olynick LLP

(57) ABSTRACT

The invention relates generally to electrodeposition apparatus and methods. When depositing films via electrodeposition, where the substrate has an inherent resistivity, for example, sheet resistance in a thin film, methods and apparatus of the invention are used to electrodeposit materials onto the substrate by forming a plurality of ohmic contacts to the substrate surface and thereby overcome the inherent resistance and electrodeposit uniform films. Methods and apparatus of the invention find particular use in solar cell fabrication.

27 Claims, 9 Drawing Sheets

U.S. PATENT DOCUMENTS

| | | | | |
|---|---|---|---|---|
| 2003/0089598 | A1 | 5/2003 | Basol et al. | |
| 2003/0132102 | A1 | 7/2003 | Liu et al. | |
| 2004/0055893 | A1 * | 3/2004 | Lubomirsky et al. | 205/123 |
| 2004/0137800 | A1 | 7/2004 | Jing | |
| 2004/0231994 | A1 | 11/2004 | Basol et al. | |

OTHER PUBLICATIONS

International Written Opinion for PCT/US2011/036339 mailed Dec. 20, 2011.

* cited by examiner

APPARATUS AND METHODS FOR FAST CHEMICAL ELECTRODEPOSITION FOR FABRICATION OF SOLAR CELLS

FIELD OF INVENTION

The invention relates generally to electrodeposition apparatus and methods. Methods and apparatus described herein find particular use in solar cell fabrication.

BACKGROUND

Electrodeposition is generally a plating process that uses electrical current to reduce or oxidize chemical species of a desired material from a solution and coat a conductive substrate with a thin layer of that material. An electroplating system typically includes two electrodes and an electrolyte. Additionally, a reference electrode may also sometimes be employed. In an electrodeposition process, typically the part to be coated is one of the electrodes and the coating material is supplied from the electrolyte in which the electrodes are immersed. In electroplating, the electrolyte is replenished periodically with the chemical species being deposited on the substrate. Sometimes, the electrode that is not being coated can be a source of the chemical species in order to replenish the electrolytic solution.

Solar or photovoltaic cells are devices that convert photons into electricity by the photovoltaic effect. Solar cells are assembled together to make solar panels, solar modules, or photovoltaic arrays. Thin film solar cells are stacked structures, having layers of materials, including photovoltaic materials, stacked on a substrate for support of the stack. There are many fabrication techniques used for fabricating the individual layers of the stack. One particularly useful method is electrodeposition, however there are drawbacks to conventional apparatus and methods in this respect. For example, when electrodepositing a material onto an electrically insulating substrate, such as glass, a conductive coating must be applied to the substrate in order to allow electric currents to pass. These conductive coatings are typically thin and can have high sheet resistance which produces a voltage drop and current non-uniformities when electroplating over a large area. In these cases uniform deposition of the electroplated film is problematic.

What is needed, therefore, are improved apparatus and methods for electrodeposition on large area, resistive substrates. Given the demand for renewable energy, improved apparatus and methods are particularly important for solar cell fabrication where the typical substrate is glass coated by a thin layer of transparent conductive oxide.

SUMMARY

The invention relates generally to electrodeposition apparatus and methods. The inventors have found that when depositing films via electrodeposition, where the substrate has an inherent resistivity, for example, sheet resistance in a thin film, methods and apparatus described herein can be used to electrodeposit materials onto the substrate by forming a plurality of ohmic contacts through the substrate surface to an underlying conducting layer, for example a transparent conductive oxide, and thereby overcome the inherent resistance to electrodeposit uniform films thereon. Methods and apparatus described herein find particular use in solar cell fabrication.

One embodiment is an apparatus for electrodeposition, including: (i) a counter electrode including a plurality of apertures normal to a surface of the counter electrode that faces a substrate surface during electrodeposition; and (ii) a plurality of contact pins, each contact pin of said plurality of contact pins registered with, and configured to pass through, each aperture of said plurality of apertures and establish electrical contact with the substrate surface while being electrically isolated from the counter electrode during electrodeposition. Some embodiments described herein employ spring-type contact pins, compliant pins or rigid pins, depending upon the application. Particular materials and configurations of apparatus in accord with embodiments of the invention are described in more detail below.

Another embodiment is a method of electrodeposition, including: (a) establishing a plurality of ohmic contacts through a substrate film to an underlying electrically conductive film using a plurality of contact pins, said plurality of contact pins electrically isolated from a counter electrode; and (b) electrodepositing a material from an electrolyte onto the substrate film. Methods described herein are meant to address films that, although having some intrinsic conductivity, have a resistivity that must be overcome in order for uniform plating to occur, and therefore ohmic contacts are established through the film to an underlying electrically conductive film. One aspect of methods described herein is establishing such ohmic contacts via the substrate film from the front side, that is, the side facing a counter electrode during deposition onto the substrate film. In one embodiment, ohmic contact is established by exploiting materials that allow such contact at or around the plating voltage. In other embodiments, a breakdown voltage is applied to establish ohmic contact without the need for more expensive materials that match well to the substrate to allow ohmic contact at or around the plating voltage.

Using methods described herein, higher plating currents can be used without sacrificing film uniformity, either in thickness of the film or the chemical stoichiometry of the film. Particular aspects of methods are described in more detail below.

DETAILED DESCRIPTION

A. Making a Solar Cell

Figure 1:
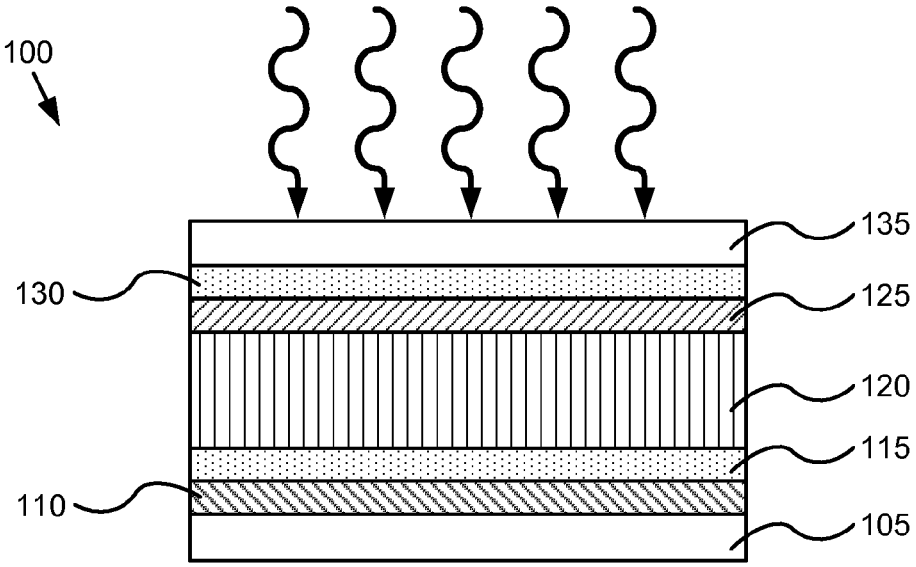
FIGS. 1 and 2 depict cross-sections of solar cell photovoltaic stack structures.

FIG. 1 depicts a simplified diagrammatic cross-sectional view of a typical thin film solar cell, 100. As illustrated, thin film solar cells typically include the following components: back encapsulation, 105, substrate, 110, a back contact layer, 115, an absorber layer, 120, a window layer, 125, a top contact layer, 130, and top encapsulation layer, 135.

Back encapsulation can generally serve to provide encapsulation for the cell and provide mechanical support. Back encapsulation can be made of many different materials that provide sufficient sealing, moisture protection, adequate mechanical support, ease of fabrication, handling and the like. In many thin film solar cell implementations, back encapsulation is formed from glass although other suitable materials may be used.

A substrate layer can also be used to provide mechanical support for the fabrication of the solar cell. The substrate can also provide electrical connectivity. In many thin film solar cells, the substrate and back encapsulation are the same. Glass plate is commonly used in such instances.

A back contact layer can be formed from a thin film of material that provides one of the contacts to the solar cell. Typically, the material for the back contact layer is chosen such that the contact resistance for the electrons/holes flowing from/to the absorber layer is minimized. This result can be achieved by fabricating an ohmic or a tunneling back contact layer. This back contact layer can be formed from many different materials depending on the type of thin film solar cell. For example, in copper indium gallium diselenide (CIGS) solar cells, this layer can be molybdenum. In cadmium telluride (CdTe) thin film solar cells, this back contact layer can be made, for example, of nickel or copper. These materials are merely illustrative examples. That is, the material composition of the back contact layer is dependent on the type of absorber material used in the cell. The thickness of a back contact layer film is typically in the range of a few microns.

The absorber layer is a thin film material that generally absorbs the incident photons (indicated in FIG. 1 by the squiggly lines) and converts them to electrons. This absorber material is typically semiconducting and can be a p-type or an n-type semiconductor. An absorber layer can be formed from CIGS, CdTe or amorphous silicon. The thickness of the absorber layer depends on the semiconducting material, and is typically of the order of microns, varying from a few microns to tens of microns.

A window layer is also typically a thin film of semiconducting material that creates a p-n junction with the absorber layers and, in addition, allows the maximum number of photons in the energy regime of interest to pass through to the absorber layer. The window layer can be an n or p-type semiconductor, depending on the material used for the absorber layer. For example, the window layer can be formed from a cadmium sulphide (CdS) n-type semiconductor for CdTe and CIGS thin film solar cells. The typical thickness of this layer is of the order of hundreds to thousands of angstroms.

A top contact is typically a thin film of material that provides one of the contacts to the solar cell. The top contact is made of a material that is transparent to the photons in the energy regime of interest for the solar cell. This top contact layer is typically a transparent conducting oxide (TCO). For CdTe, CIGS, and amorphous silicon thin film solar cells, the top contact can be formed from, for example, indium tin oxide (ITO), aluminum doped zinc oxide (ZnO) or flourine doped tin oxide ($SnO_2$). The top contact layer thickness can be of the order of thousands of angstroms.

A top encapsulation layer can be used to provide environmental protection and mechanical support to the cell. The top encapsulation is formed from a material that is highly transparent in the photon energy regime of interest. This top encapsulation layer can be formed from, for example, glass.

Thin film solar cells are typically connected in series, in parallel, or both, depending on the needs of the end user, to fabricate a solar module or panel. The solar cells are connected to achieve the desired voltage and current characteristics for the panel. The number of cells connected together to fabricate the panel depends on the open circuit voltage, short circuit current of the cells, and on the desired voltage and current output of the panel. The interconnect scheme can be implemented, for example, by laser scribing for isolation and interconnection during the process of the cell fabrication. Once these panels are made, additional components such as bi-pass diodes, rectifiers, connectors, cables, support structures etc. are attached to the panels to install them in the field to generate electricity. The installations can be, for example, in households, large commercial building installations, large utility scale solar electricity generation farms and in space, for example, to power satellites and space craft.

As mentioned above, electrodeposition is an attractive methodology for depositing various layers of thin film solar cells. Processes have been developed for the deposition of the back contact, absorber, window and top contact layers using electrodeposition.

For illustration purposes, electrodeposition is described herein as being used in the fabrication of CdTe-based solar cells although electrodeposition can be used to fabricate any number of other types of solar cells or other types of thin films products and/or devices. That is, the invention is not limited to this exemplary electrodeposition chemistry.

Solar cell photovoltaic stacks are conventionally constructed in an order starting from, for example, a top encapsulation layer, a top contact layer, a window layer, an absorber layer, a back contact layer and so on, that is, in an order opposite of the description of the layers with reference to FIG. 1.

Figure 2:
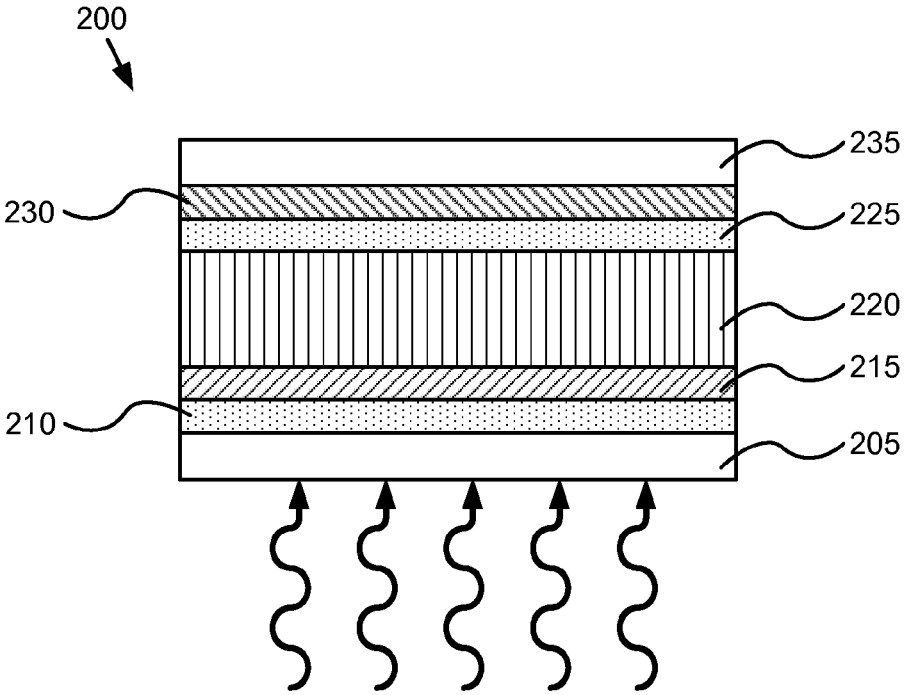

FIG. 2 shows a diagrammatic illustration of conventional photovoltaic stack formation. The process starts with the top encapsulation layer, and the cell stack is built by subsequent depositions of top contact layer, window layer, absorber layer, etc. Other layers may be formed in addition to the described layers and formation of some of the described layers is optional, depending on the desired cell stack structure.

Referring again to FIG. 2, the TCO-coated glass (for example, the top encapsulation layer 205 and top contact layer 210) can be initially cleaned, dried, cut to size, and edge seamed. Float glass with transparent conductive oxide coatings, for example indium tin oxide, doped zinc oxide or doped tin oxide, are commercially available from a variety of venders, for example, glasses sold under the trademark TEC Glass™ by Pilkington of Toledo, Ohio, and SUNGATE™ 300 and SUNGATET™ 500 by PPG Industries of Pittsburgh, Pa. TEC Glass™ is a glass coated with a fluorinated tin oxide conductive layer. A wide variety of solvents, for example deionized water, alcohols, detergents and the like, can be used for cleaning the glass. As well there are many commercially available industrial-scale glass washing apparatus appropriate for cleaning large substrates, for example, Lisec™ (a trade name for a glass washing apparatus and process available from (LISEC Maschinenbau Gmbh of Seitenstetten, Austria).

Methods described herein are exemplified as being carried out on substantially flat substrates, such as conventional glass substrates. However, methods described herein can also be employed substrates with non-planar geometries, such as cylinders, curved and/or irregular contoured surfaces, depending on the desired configuration of the final product photovoltaic device. One embodiment is any method described herein wherein the substrate comprises a curved architecture, for example a cylinder, a parabola, a cone, a hemisphere, and the like. The curved architecture can be convex, concave or have both components, depending upon the need.

Once the TCO coated glass is cleaned, a CdS layer, 215, may then be deposited, for example, by using an aqueous solution of, for example, a cadmium salt and elemental sulfur composition. The solution does not have to be aqueous. That is, other solvents, such as dimethylsulfoxide (DMSO), can be used. This deposition can be done using electrodeposition. For electrodeposition, the ITO coated glass can form one of the electrodes. The other electrode can be, for example, made of graphite, and the electrolyte can be, for example, a DMSO solution of a cadmium salt and elemental sulfur. Potential is applied between the electrodes so that CdS is deposited from the solution onto the ITO coated glass substrate. Another method of depositing the CdS layer is chemical deposition, for example via wet chemistry or dry application such as CVD. The CdS deposited is an n-type semiconductor and its thickness is typically between 500 Å and 1 μm. Subsequent to the deposition, the layer can be annealed, for example under an inert atmosphere such as argon, to achieve film densification and grain growth to improve the electrical and mechanical properties of the CdS film.

A cadmium telluride layer, 220, can then be electrochemically deposited on the CdS/TCO/Glass stack (now a substrate for electrodeposition), for example, from an acidic or basic media containing a cadmium salt and tellurium oxide. In this process, the CdS/TCO/Glass substrate forms one of the electrodes and platinum or other materials can be used as the other electrode. The electrolyte can contain an acidic or basic media, in solvents such as water, DMSO or other solvents, with a cadmium salt and tellurium oxide, for example. Films of thickness ranging from 1 to 10 μm are typically deposited. Cadmium telluride films may then be annealed at approximately 400° C. in an air or oxygen or $CdCl_2$ environment so as to improve the electrical properties of the film and also to convert the CdTe film to a p-type semiconductor. It is believed that these methods optimize grain size and thus improve the electrical properties of the films.

After this CdTe deposition and annealing, a laser scribing process is typically performed to remove CdS and CdTe from specific regions (not shown). In this scribing operation, the laser scribing is utilized such that CdS and CdTe are removed from specific regions of the solar panel. However, the conductive oxide (for example, Al doped ZnO or ITO) is not removed by the laser scribe. Then a second laser scribing step is performed in which CdS, CdTe and TCO are removed from specified regions.

A back contact layer, 225, can then be deposited on the CdTe layer, using for example sputtering or electrodeposition. For example, copper, nickel and/or other metals, alloys and composites can be used for the back contact layer. This back contact fabrication step can be followed by an anneal, for example, at temperatures of between about 150° and about 200° C. to form an ohmic contact. The back contact layer can cover the CdTe layer and also fill the vias (not shown) created in the CdTe/CdS layer by the laser scribing process.

After back contact layer deposition and annealing, laser scribing can typically be used to remove the back contact layer material from specific areas, but the CdTe layer is not etched away in this process. This removal step can complete the process for isolation and interconnecting the solar cells in series in the solar panel/module.

After the deposition of the back contact layer, an encapsulation layer, 230, can be applied, for example, using ethylvinyl acetate (EVA). Encapsulation protects the photovoltaic stack. Glass, 235, can be added for further structural support (and protection) of the stack.

The above described fabrication process represents a brief outline and many variants of this process can be employed for the fabrication of CdTe thin film solar cells. For other types of thin film solar cells, different chemicals, etc. can be employed. In this description, example process steps have been described for illustrative purposes. Other steps would typically include additional details of the laser scribing and ablation steps employed for the fabrication of the interconnect schemes and cell isolations, multiple clean and drying steps between the different layer depositions and the like. Values for the layer thicknesses, anneal temperatures, chemical composition etc. described herein are merely illustrative and are not meant to limit the scope of the invention. These values can vary across a wide range as processes are optimized for many different output variables.

Figure 3:
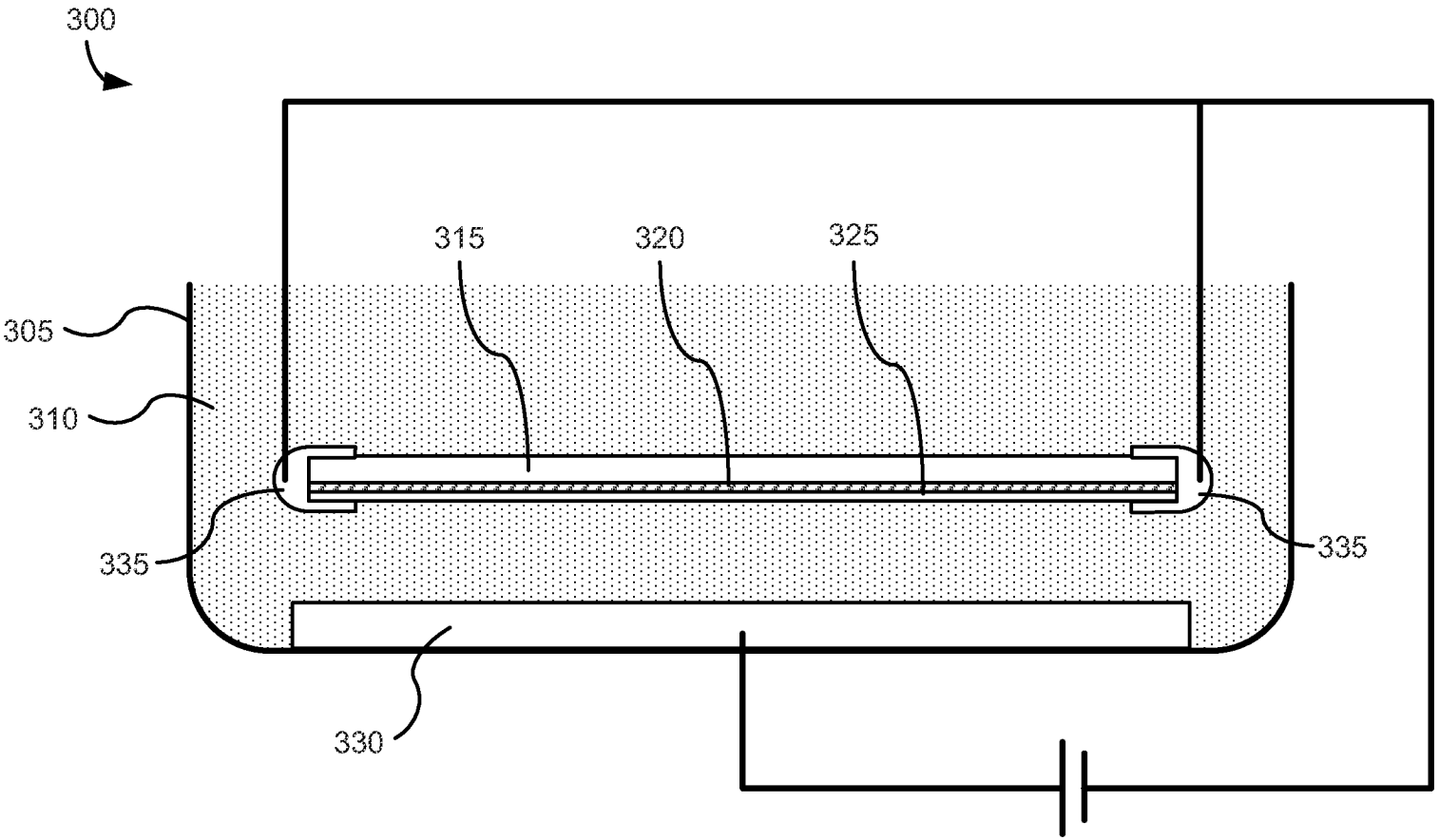
Figure 3 (Prior Art)
FIG. 3 depicts a cross-section of a conventional electrodeposition apparatus.

FIG. 3 shows a cross sectional schematic of a conventional electrodeposition apparatus, 300, that is used for depositing various layers for solar cell fabrication. This apparatus configuration can be employed, for example, for electrodeposition of CdTe on a glass substrate coated with TCO and CdS. Apparatus 300 includes a large tub, 305, which holds the electroplating solution, 310, in which a substrate, in this example glass, 315, with a TCO, 320, and a CdS layer, 325, (the TCO and CdS layer, collectively, are the working electrode) and a counter electrode, 330, are immersed. Deposition on the working electrode is achieved by application of an electric field between the electrodes and deposition occurs via reduction of an ionic species from the electrolyte onto the substrate working electrode, in this example onto CdS layer 325.

In a typical configuration electrodeposition contacts, 335, to the working electrode are made at the edges of the working electrode as depicted. This configuration works well when the working electrode is highly conductive, for example metallic, and therefore has little sheet resistance. However when the electrodeposition is performed on, for example, CdS/TCO/glass, where CdS/TCO is the working electrode, this configuration is problematic. For example, when using electrodeposition to achieve high quality, stochiometrically-correct films, the potential at the surface of the working electrode has to be kept fairly uniform. For example for electrodeposition of CdTe on a CdS/TCO, the potential across the full surface of the working electrodes can not vary by more than of the order of milli-volts. The thickness of the film deposited in electrodeposition is proportional to the total charge that flows through the system, and the total charge flowing through the system is a function of the current and the time for which the current flows. Since electrodeposition on large area substrate working electrodes is desirable, and potential drop across such substrate's large surfaces occurs due to only peripheral supply of potential, deposited film uniformity suffers unless steps are taken to mitigate potential drop across the substrate and/or underlying electrically conductive layer, for example, a transparent conductive oxide.

In order to minimize the time that it takes to achieve a given thickness of film, the current flowing through the system has to be increased. For example, for electrodeposition of CdTe on a CdS/TCO/Glass substrate the sheet resistance of the TCO is on the order of 2-20 ohms/square. The area of a typical substrate is on the order of square meters. For this resistance and area, if the substrate, for example via the TCO, is contacted only from the periphery, and the potential drop across the substrate surface has to be maintained to within milli-volt tolerances, then the total current is limited to a range on the order of tens to hundreds of micro-amps per square centimeter. At these currents, for example if a few microns of CdTe film is to be deposited, it can take on the order of several hours to deposit the CdTe film. This severely limits the throughput of conventional electrodeposition equipment and significantly increases the cost of production of solar cells. If the current is increased during the deposition in an attempt to improve the throughput of the equipment, then the result is significantly higher potential drops and corresponding non-uniformities in the CdTe film thickness and composition across the surface of the substrate, which results in poor quality solar cells.

B. Apparatus and Methods

The inventors have found that many of the above-described limitations of conventional electrodeposition can be overcome. In certain embodiments, the substrate is contacted in a manner that alleviates the potential drop constraints and permits the use of significantly higher deposition currents to improve throughput while maintaining high-quality uniform films.

As mentioned above, one embodiment is an apparatus for electrodeposition, including: (i) a counter electrode including a plurality of apertures normal to a surface of the counter electrode that faces a substrate surface during electrodeposition; and (ii) a plurality of contact pins, each contact pin of the plurality of contact pins registered with and configured to pass through each aperture of the plurality of apertures and establish electrical contact with the substrate surface but be electrically isolated from the counter electrode during electrodeposition.

Figure 4A:
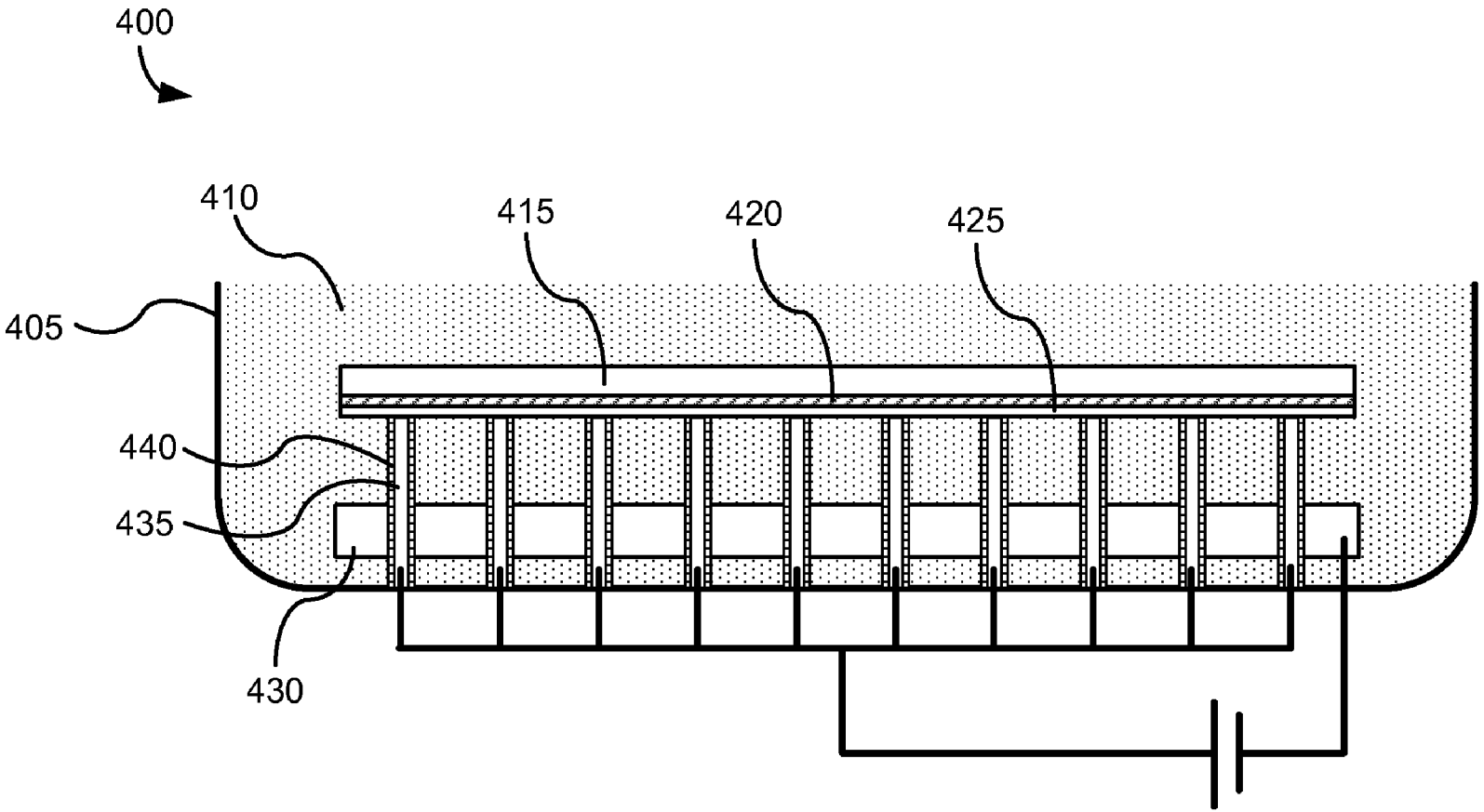
FIG. 4A depicts cross-section of an electrodeposition apparatus in accord with embodiments of the invention.
Figure 4B:
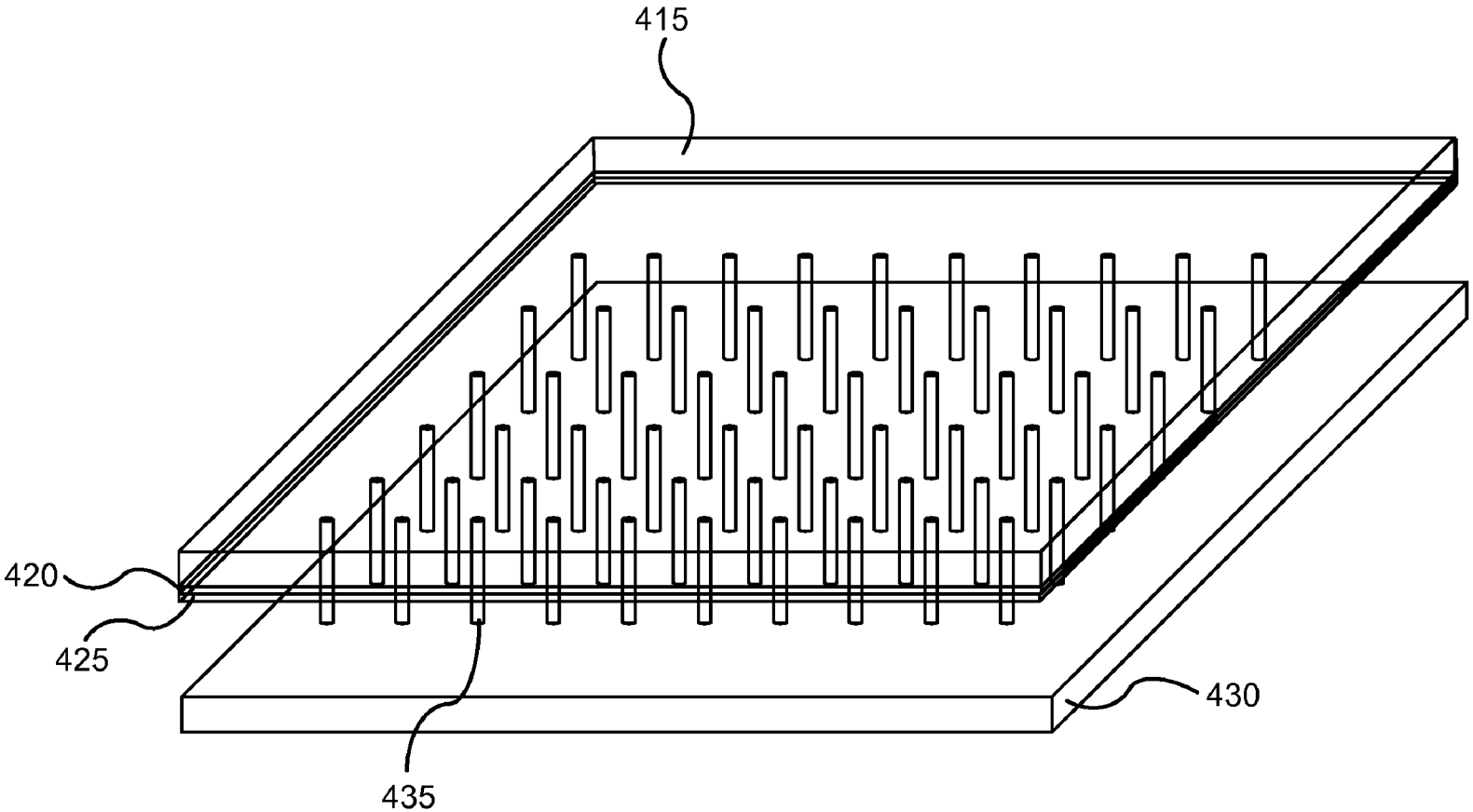
FIG. 4B depicts a perspective of components of an electrodeposition apparatus in accord with embodiments of the invention.

FIG. 4A depicts a cross-section of an electrodeposition apparatus, 400, in accord with embodiments of the invention. Apparatus 400 includes a tub, 405, for the electrolyte, 410. During deposition, a substrate, in this example glass substrate 415, having a TCO, 420, and a CdS film, 425, thereon, makes contact with a plurality of contact pins (or probes) 435. Contact pins are electrically isolated from a counter electrode, 430, in this example via an insulating coating, 440, on contact pins 435. Although the back side (top side as depicted) of glass substrate 415 is depicted as being exposed to electrolyte 410, embodiments of the invention provide electrolyte contact to only the plating face of the substrate. For example, substrate handling and positioning components (not depicted) can seal and protect the backside of the substrate during film deposition and/or the substrate is only immersed in the eletrolyte sufficiently to expose the plating side to electrolyte. During electrodeposition, a potential is applied across the electrodes, in this example CdS film 425 and counter electrode 430, in order to deposit an ionic species from electrolyte 410 and onto CdS film 425. Depending on the type of pins used, the pins can be, for example, fixed or slideably engaged with counter electrode 430. FIG. 4B depicts a perspective of the substrate with layers 415, 420 and 425, as well as pins 435 and counter electrode 430. Pins 435 can be arranged in various patterns and pin densities depending on the desired outcome, as will be described in more detail below.

The contact pins can include at least one of a rigid pin, a compliant pin and a spring-type pin. That is, some embodiments of the invention include apparatus with combinations of pin type, depending on the desired outcome of the deposition. A rigid pin is a pin that is relatively rigid, that is, the pin does not deform or bend substantially upon contact with the substrate. A compliant pin is a pin that does have some give, that is, it can deform or bend upon contact with the substrate. Compression contact between a compliant pin and the substrate can be varied in force by, for example, using compliant pins made with varying amounts of compliancy, for example, by varying thickness of pins made of a single material and/or by making pins from different materials and or making flexures on the pins that provide compliance. A spring-type pin is a pin, with a rigid or compliant component, that specifically can deform or otherwise move or be displaced vertically with respect to the substrate. That is, a spring-type pin makes a compression contact with the substrate via a mechanism such as a spring, a pneumatic device, an elastomeric member and the like. Thus a spring-type pin can have a rigid pin component with, for example, a spring device that allows the rigid pin to move normally to the surface of the substrate upon engagement with the substrate such that a compression contact is made with the substrate. One embodiment of the invention is an apparatus as described above with spring-type contact pins.

The contact pins can be made of materials that are chemically resistant to the electrolyte and/or are coated with a material that protects them from the electrolyte and also may serve as an insulating material to electrically isolate the pins from the counter electrode. Contact pins can be made of a variety of metallic materials or coatings. Suitable materials for contact pins of the invention include one of gold, titanium, tungsten, steel, titanium nitride, and indium or alloys of these and other metallic materials. In one embodiment, the contact pins include a material, for example made of or coated with, that does not dissolve in the electrolyte nor plate under the plating conditions employed. That is, materials need not necessarily be coated with an additional material to protect the pins from the corrosive electrolyte and/or protect the substrate from contamination from material dissolved from the pins by the electrolyte. Suitable materials for this embodiment include gold, tungsten, titanium, titanium nitride, steel, and indium or alloys of these and other metallic materials.

Preferably, the pins are made of material that makes good electrical contact with the substrate. Thus the material used in the tip or contact area of the pin can be tailored to the particular needs of the deposition system and chemistry. For example, if the substrate consists of CdS/TCO/Glass, where deposition is to occur on a film of CdS, then the tips of the contact pins can be coated with or made of indium and/or an alloy of indium. Indium makes a good ohmic contact with CdS under plating conditions without the need to apply higher potentials to break down resistance to ohmic contact. "Ohmic contact" means a region on the substrate where the current-voltage (I-V) curve of the substrate in the localized contact region is linear and symmetric. Put another way, an ohmic contact is a contact with voltage independent resistance, that is, a contact having a negligible resistance regardless of the polarity of the applied voltage. Thus, since the resistance is negligible at the ohmic contacts, plating potential can be supplied to an underlying electrically conductive layer without substantial resistance from the substrate layer. Also, the contact pins should be mechanically robust to minimize wear and tear and reduce operating costs and down time of the tool, and, as mentioned, should be chemically compatible (either coated with insulator or not) with the electrolyte being used, and preferably are cost effective.

In the example in FIGS. 4A and 4B, contact pins 435 are electrically isolated from counter electrode 430 via an insulator material, 440, coated on the pins (except for the contact area where the pins engage the substrate). Electronic isolation can be achieved either by appropriate spacing, that is, non-contact with the counter electrode or via appropriately configured insulating materials. As mentioned, in one embodiment this is achieved by coating the contact pins with an electrically insulating material everywhere except at the tip of the probes where they make electrical contact with the substrate. Suitable electrically insulating materials include at least one of polytetrafluoroethylene (PTFE), perfluoroalkoxy (PFA), polytetrafluoroethylene perfluoromethylvinylether (MFA), fluorinated ethylene propylene (FEP), ethylene tetrafluoroethylene (ETFE), ethylene chlorotrifluoroethylene (ECTFE), polyvinylidene fluoride (PVDF), tetrafluoroethylene hexafluoropropylene vinylidene fluoride (THV), polyetheretherketone (PEEK), polyetherimide (PEI) and poly (para-xylylene) sold commonly as "Parylene"). Coating the contact pins with an electrically insulating material, depending on the material chosen, can provide the benefit of preventing deposition on the pins during electrodeposition, which could be beneficial to the life time of the pins and also prevent contamination of the electrolyte from the pins. One embodiment of the invention is an apparatus as described above, where the plurality of contact pins includes at least a subset of pins that are coated with an electrically insulating material except for a portion of each pin that makes contact with the substrate surface during electrodeposition. That is, embodiments of the invention include apparatus that have a plurality of contact pins, where the pins vary in configuration, materials, spacing and the like. For example, electrodeposition can be tailored by voltage regimes applied across the pins, but also by varying the pin materials across a grid of pins, spacing of the pins, pressure of contact of the pins and the like.

Coating the pins is but one approach to electrically isolating the contact pins from the counter electrode. There are many other ways in which the contact pins can be electrically isolated from the counter electrode. In one embodiment, the apertures in the counter electrode through which the contact pins pass are coated with an insulating material as described above. Embodiments of the invention include combinations of electrical isolation configurations as described above. For example, electrically insulating the pins, apertures in the counter electrode, using appropriate spacing between the contact pins and the counter electrode, etc. can be used in combination to provide suitable electrical isolation of the contact pins from the counter electrode. Any of the above electronic isolation methods can be employed in any combination.

The counter electrode can be made of many different materials as would be understood by one of ordinary skill in the art. In general, the counter electrode is electrically conductive, chemically compatible with the electrolytic solution, and meets any cost considerations. In one embodiment, the counter electrode includes at least one of platinum, graphite, titanium, tungsten, titanium suboxide (for example as sold under the trade name, Ebonex™, by Atraverda of South Wales, UK) and titanium nitride.

The spacing of contact pins can be optimized to achieve the best throughput possible which will be dictated by the particulars of the process. For example, if the conductive layer (for example, the TCO layer of a CdS/TCO/glass substrate) of the substrate has a sheet resistance of 10 ohms per square and the current desired during the deposition is 2 mA per square centimeter, then a contact pin spacing of, for example, 2 cm per square will result in a maximum potential drop across the whole substrate of less than 20 mV. Thus, precise control of the potential drops across the surface of the substrate can be tailored by appropriate pin spacing (which also depends on pin materials and configurations, for example, contact area) even at high deposition currents so as to allow the fabrication of uniform layers at high throughputs. In one embodiment, the plurality of contact pins includes a pin density of between about 100 pins/$m^2$ and about 10,000 pins/$m^2$, in another embodiment between about 500 pins/$m^2$ and about 1000 pins/$m^2$, in another embodiment between about 550 pins/$m^2$ and about 750 pins/$m^2$, and in yet another embodiment between about 650 pins/$m^2$ and about 675 pins/$m^2$, in another embodiment about 667 pins/$m^2$.

As mentioned above, optimal pin spacing can depend on, for example, the contact area of the contact pins, that is, where a pin interfaces with the surface of the plating substrate. Since each pin may contact the substrate slightly differently, the contact area of the individual pins may be expressed in terms of an average contact area. Contact pins can have surfaces that make contact with the substrate where the surfaces can have various shapes to optimize contact, for example, flat surfaces or pointed or wedge-shaped surfaces that dig into the substrate to establish better electrical contact. The contact pins can have various cross-sections, for example, to facilitate manufacturing and/or electrolyte flow around the pins. In many cases, contact pins will be relatively thin, so that the average contact area is reflected in the average diameter of the pin. In one embodiment, each pin of the plurality of pins has an average diameter of between about 10 microns and about 1000 microns, in another embodiment between about 100 microns and about 800 microns, in another embodiment between about 150 microns and about 750 microns, in another embodiment between about 200 microns and about 600 microns, and in yet another embodiment between about 250 microns and about 500 microns.

Smaller diameter pins are useful for a number of reasons, one of which is creating smaller "dead" areas in the deposited film. That is, where the pins contact a substrate, deposition of the new film is blocked and thus "voids" or holes are created after the pins and the substrate are disengaged. These holes in the newly deposited film must be appropriately addressed in order to create, for example, a functional photovoltaic stack. This aspect is described in more detail below.

Figure 4C:
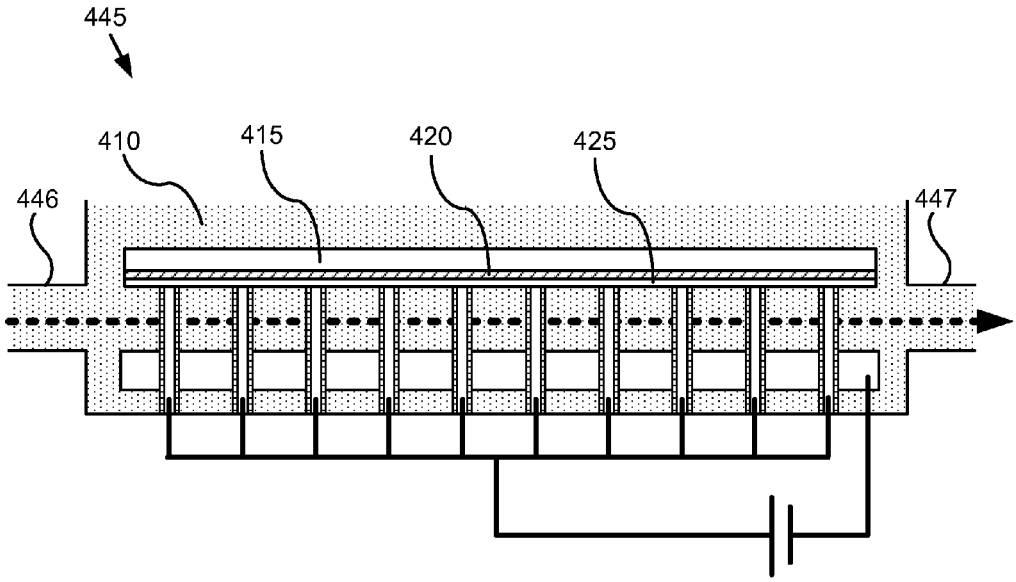
FIG. 4C depicts a cross-section of components of an electrodeposition apparatus in accord with embodiments of the invention.
Figure 4D:
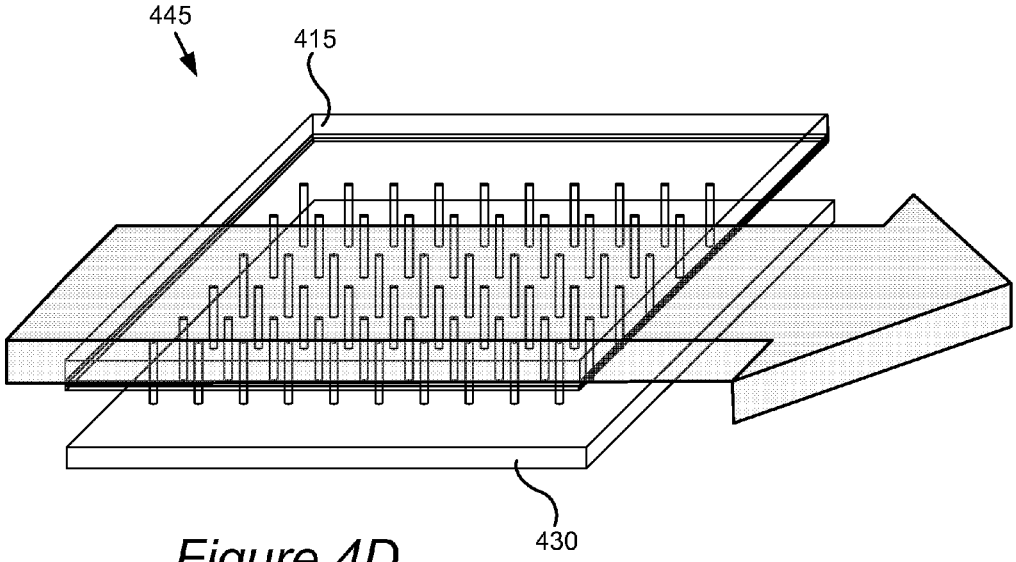
FIGS. 4D and 4E depict perspectives of components of an electrodeposition apparatus in accord with embodiments of the invention.

Contact pin configurations as described herein can be used for static bath deposition equipment or for equipment in which the electrolyte is flowing through the equipment. For example, FIG. 4A depicts a static type bath, for example, for batch electrodeposition. FIGS. 4C and 4D depict apparatus that employ electrolyte flow between the electrodes during electrodeposition. By flowing the electrolyte during electrodeposition, higher-current depositions are possible because electrolyte depletion effects are minimized. That is, the depleted electrolyte is continuously replenished from the flow. Referring to the example in FIG. 4C, an electrodeposition apparatus, 445, which has similar features as apparatus 400, has an electrolyte chamber with one or more flow inlets, 446, and flow outlets, 447, for producing, in this example, a laminar flow (as depicted by the dashed arrow) of electrolyte 410. FIG. 4D is a perspective showing generally a laminar flow (as depicted by the heavy arrow) between the electrodes during deposition.

Since the contact pins have volume, in such a laminar flow scenario, it is possible that the contact pins can create a shadowing effect. That is, due to the contact pin's leading side or edge interaction with a substantially unidirectional laminar flow of electrolyte, an area adjacent to the contact pin and opposite the side of the pin that encounters the electrolyte first, there can be a differential fluid pressure at that area adjacent to the pin and this can create a localized different deposition rate than that on the rest of the substrate. If the contact pins have a small enough average diameter, then these effects can be minimized or made insignificant. Also, the cross-section of the pins can be made more aerodynamic so that there is substantially laminar flow around the entire pin (rather than laminar flow at the leading edge or side and turbulent flow at the opposite edge or side). Also, this shadowing effect can be overcome by flowing the electrolyte in a turbulent fashion, where the parameters of the electrolyte and the process permit operation in the turbulent flow regime. Thus, one embodiment is an apparatus as described herein configured to flow an electrolyte between the substrate surface and the counter electrode in a substantially laminar flow. Another embodiment is an apparatus as described herein configured to flow an electrolyte between the substrate surface and the counter electrode in a turbulent fashion. In one embodiment, the counter electrode includes apertures through which electrolyte flows normally to the surface of the counter electrode and encounters the substrate surface normally, for example, a shower head type counter electrode. That is, for uniform deposition on the substrate, the counter electrode need not have a continuous surface, for example, the apertures for the contact pins do not prevent uniform deposition on the substrate and therefore additional apertures can be included for electrolyte flow as described.

Other apparatus for performing electrodeposition will typically include a mechanism for placing the substrate in the appropriate location and for engaging the substrate with the contact pins. Electrodeposition can be commenced once the pins make suitable electrical contact with the substrate and the electrolyte is present. The composition of the electrolyte depends on the material to be deposited. Examples of electroplating solutions that can be used for fabricating different layers of CdTe solar cells are described above.

Figure 4E:
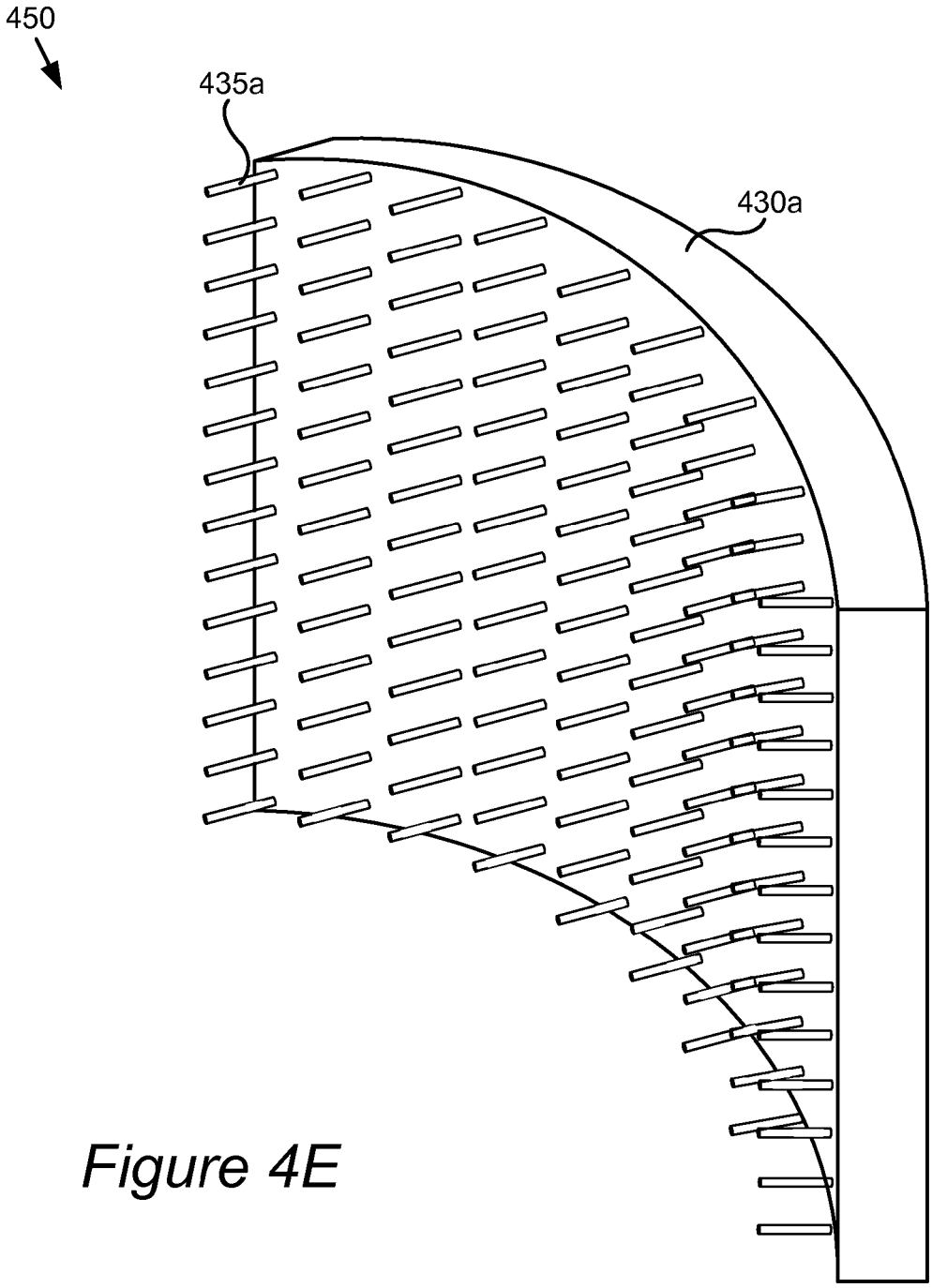

As mentioned, the substrate need not be planar or substantially flat, it can be curved. In the event plating is to be performed on a curved substrate, for example a cylinder, the counter electrode and contact pins are configured appropriately to carry out methods described herein. FIG. 4E depicts a component, 450, of an apparatus of the invention that has a curved counter electrode, 430*a*, through which (in accord with the description in relation to flat counter electrode 430, for example, in FIG. 4B) contact pins 435*a* protrude. Thus, one embodiment is an apparatus configured to carry out methods described herein on a curved substrate. Such apparatus can electrodeposit on a curved substrate such as a cylinder or curved plane. Another embodiment is a method as described herein carried out on a curved substrate.

FIGS. 4A-E are simplified illustrations of electrodeposition apparatus embodiments. Other components of the equipment, such as electronics for control systems, for applying potentials to the electrodes, chemical handling systems for the electrolyte etc., are not depicted, so as to simplify the discussion. The dimensions of the different components of the system can vary across a large range depending on the application for which the equipment is intended without escaping the scope of the invention.

The electrodeposition apparatus may also include a controller system for managing the different components of the system. By way of example, the controller may be configured or programmed to select the potential difference that is applied between the substrate and the electrode, control electrolytic flow rate and fluid management, control movement mechanisms, register contact pins with a counter electrode, verify connectivity of contact pins with the substrate, apply voltages to individual pins, and the like. Any suitable hardware and/or software may be utilized to implement the controller system. For example, the controller system may include one or more microcontrollers and microprocessors such as programmable devices (for example, complex programmable logic devices (CPLD's) and field programmable gate arrays (FPGA's) and unprogrammable devices such as gate array application specific integrated circuits (ASIC's) or general-purpose microprocessors and/or memory configured to store data, program instructions for the general-purpose processing operations and/or the inventive techniques described herein.

Another embodiment is a method of electrodeposition, including: (a) establishing a plurality of ohmic contacts through a substrate film to an underlying electrically conductive film using a plurality of contact pins, the plurality of contact pins electrically isolated from a counter electrode; and (b) electrodepositing a material from an electrolyte onto the substrate film. As described above, methods of the invention find particular use where the substrate film has limited conductivity and thus an instrinsic sheet resistance, especially where deposition is to be performed on substrates having large areas. By establishing a plurality of ohmic contacts to an underlying conductive layer, higher plating currents can be used while addressing potential drops across large plating areas. In the scenario where the underlying electrically conductive layer is, for example, a relatively thin transparent conducting oxide, its sheet resistance is addressed via the ohmic contacts through the substrate layer and thus higher plating currents can be used without large potential drops across the transparent conductive oxide.

"Substrate film" means a film or layer that is part, or will be a part, of an electronic device, such as a photovoltaic device. In one embodiment, a substrate film has a thickness of between about 0.01 μm and about 10 μm, in another embodiment between about 0.03 μm and about 5 μm, in another embodiment between about 0.03 μm and about 0.3 μm, and in another embodiment between about 0.1 μm and about 0.3 μm. For example, CdS can be the substrate film. Under, and adjoining the substrate film is an electrically conductive layer to which ohmic contacts are made through the substrate film. The electrically conductive layer has an inherent sheet resistance that is compensated for during electrodeposition methods of the invention so that higher plating currents can be used without sacrificing uniformity (which would result if potential is applied only via the periphery of the electrically conductive layer as in conventional methods). In one embodiment, the electrically conductive layer has a sheet resistance of between about 1 ohm per square and about 30 ohms per square, in another embodiment between about 2 ohms per square and about 20 ohms per square, in another embodiment between about 5 ohms per square and about 15 ohms per square.

Figure 5:
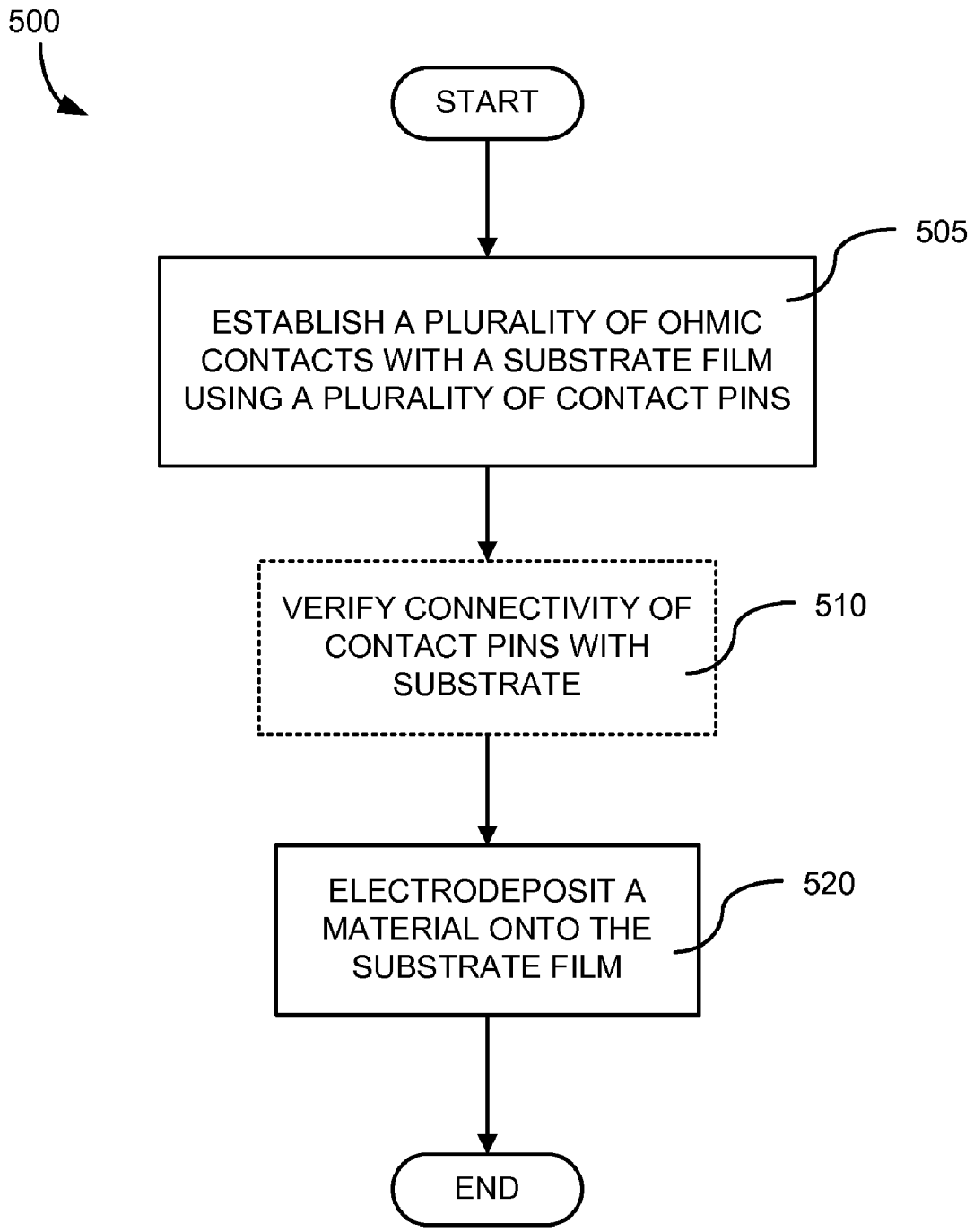
FIG. 5 depicts a process flow according to methods in accord with embodiments of the invention.

FIG. 5 depicts a process flow, 500, outlining aspects of a method for electrodeposition in accord with embodiments of the invention. First, a plurality of ohmic contacts are established through a substrate to an underlying electrically conductive layer using a plurality of contact pins, see 505. Optionally, the connectivity of the contact pins is confirmed prior to plating, see 510. Verification of pin connectivity (electrical communication with the conductive layer via the substrate film) can be achieved by configuring the contact pins as individually addressable, for example, by using a switching matrix. This connectivity check helps to ensure that uniform deposition is achieved across the substrate. Then a material is electrodeposited onto the substrate film, see 515. Then the method is complete. An example would be depositing CdTe on a CdS substrate film, for example CdS/TCO/glass substrate as described above. In one embodiment, the voltage applied to each contact pin may vary according to pre-set and/or feedback algorithms in a controller that apply voltage to individual contact pins based on the needs of the deposition in order to achieve uniform deposition of the desired material film. For example, for depositing CdTe films on a CdS/TCO/glass substrate using potentiostatic deposition, a potential of between about −200 mV and about −600 mV with respect to a silver/silver chloride (Ag/AgCl) reference electrode can be used. Also, methodologies that adjust the potential during the deposition, such as methods based on Quasi Rest Potential (QRP), can also be used. In QRP based methodology, a potential is applied for deposition and the current is periodically interrupted to measure the resistive drop from which the QRP is determined. In such methods, the potential is adjusted to maintain a constant QRP during the deposition. For example, for CdTe depositions using this methodology, QRP values from between about −300 mV and about −600 mV with respect to a Ag/AgCl reference electrode can be used.

In one embodiment, establishing the plurality of ohmic contacts includes at least one of using contact pins, of the plurality of contact pins, that include a contact area which comes in contact with the substrate film, the contact area including a conductor capable of establishing ohmic contact with the substrate film at or about the plating voltage. For example, if the substrate film includes CdS, then a conductor that would allow ohmic contact within the plating voltage regime is indium. Thus in one embodiment, the contact pins are coated with and/or include indium at least in their contact area, that is, where they adjoin the substrate film upon engagement with the substrate film. Other conductors that allow such ohmic contact include, but are not limited to, aluminum, gallium, and zinc. One potential drawback of this method is the cost of the conductor as described above. For example, indium is relatively expensive. However, in the example of a CdS substrate film, the amount of indium needed is relatively small, as only the contact area of the pins need contain indium, and the contact pins typically have a small cross-section and/or tip configuration.

One embodiment is a method of electrodeposition, including: (a) establishing a plurality of ohmic contacts with a TCO via a CdS film using a plurality of contact pins, the plurality of contact pins electrically isolated from a counter electrode; and (b) electrodepositing a material from an electrolyte onto the CdS film; where (a) includes at least one of using contact pins coated with indium at least at the contact point and applying a breakdown voltage to each of the plurality of contact pins. The breakdown voltage is that as appropriate to form the ohmic contacts with the TCO. In one embodiment the electrodeposited material includes cadmium telluride.

It can be beneficial if the material for the contact pins is not constrained by requiring establishing an ohmic contact with an underlying electrically conductive layer via the substrate at or around the plating voltage. For example, for contacting CdS, the metals described above, for example indium, for forming the ohmic contacts at or around the plating voltage are typically expensive and/or not commercially available. However a large number of conductors, for example common metals, make ohmic contact with the materials commonly used, for example, in transparent conductive oxides which are under the substrate layer. In one embodiment, when electrodepositing on substrate films that have, for example, an underlying TCO, after engaging the contact pins with the substrate film, a breakdown voltage is applied to the contact pins to establish an ohmic contact to the underlying TCO. This can be done prior to introduction of electrolyte to the apparatus and/or after. That is, a breakdown voltage is applied to establish the ohmic contacts with the underlying layer rather than, for example, coating the contact pins with a material, for example indium, that allows establishment of the ohmic contacts at or near the plating potential.

"Breakdown voltage" is a term of art generally meaning the minimum voltage that causes a portion of an insulator to become electrically conductive. Substrate films, for example CdS and the like, have some conductivity, but also some inherent resistance. The breakdown voltage is the minimum voltage required to overcome the resistive component of the substrate film and allow electrical flow to the underlying conductive layer, for example, a TCO. The breakdown voltage, for example when CdS is the substrate film, is on the order of a few volts, when the CdS layer is on the order of a 1000 Å thick. This potential locally perturbs the CdS creating a conductive path to the TCO, creating an ohmic contact between the contact pins and the TCO. This embodiment makes a much wider choice of conductive materials available for the contact pins, at least for the portion configured to make contact with the substrate during deposition. In one embodiment, the breakdown voltage is high enough to breakdown the substrate film's resistance, but not so high as to reach the breakdown voltage of the underlying TCO. In one embodiment, the breakdown voltage is between about 0.5 volts and about 10 volts, in another embodiment between about 1 volt and about 5 volts, and in another embodiment the breakdown voltage is between about 2 volts and about 3 volts.

When the contact pins are engaged with the substrate film, and electrolyte is flowing, there is the possibility, depending on the materials and configuration of the contact pins and if they penetrate the substrate film, that the contact pins' position on the substrate film surface may change. That is, the electrolyte flow can physically displace the pin from its original position along the surface of the substrate film to a new position. Embodiments of the invention contemplate pin displacement from a first contact area to another contact area. Also, the breakdown voltage can change the physical characteristics of the substrate film where a portion of the substrate film in contact with the pin can be changed sufficiently so as to facilitate physical displacement of the pin's contact, for example, by the electrolyte flow. In one embodiment, a breakdown voltage is applied prior to electrolyte flow. In another embodiment, a breakdown voltage is applied after electrolyte flow. In yet another embodiment, a breakdown voltage is applied before and after electrolyte flow.

In a specific embodiment, where a breakdown voltage is applied to a CdS substrate film and deposition potential is not reached in the CdS film at the breakdown voltage, then the breakdown voltage is applied after electrolyte flow so that pin movement, for example due to the pins first encountering electrolyte flow, is irrelevant. That is, if there is little possibility of deposition at the breakdown voltage, then pin movement due to the breakdown voltage along with electrolyte flow is irrelevant, since pin movement due to these forces will have occurred prior to any deposition on the substrate film.

In another embodiment, illumination of the substrate can be used to lower its resistivity and thus aid in forming ohmic contacts. That is, since photovoltaic substrate films, for example CdS, are photoactive, then shining intense light on the substrate (layer on which deposition is to occur) lowers the resistance of the film and thus can lower the resistance to making ohmic contact, without need to apply a breakdown voltage. In one implementation the light source can be integrated with the plating apparatus. The light source can be a bright white light source or specific wavelengths of between about 400 nm and about 900 nm can be used. In one embodiment, blanket illumination of the substrate film is performed through the CdS/TCO/glass substrate with the light incident from the glass side (side opposite of where electrodeposition is to take place) of the substrate. The illumination would be applied at the beginning of the deposition to lower the contact resistance to the CdS substrate and would be turned off at or near the end of the deposition or after the deposition is complete.

In another embodiment, the physical characteristics of the substrate film are modified so as to form better ohmic contacts. For example, it has been observed that nanocrystalline cadmium sulfide films can be altered by anneal and/or swift heavy ion (SHI) irradiation to lower resistivity in the films (for example, see: *Engineering of nanocrystalline cadmium sulfide thin films by using swift heavy ions*, by R. R. Ahire et al., 2007 *J. Phys. D: Appl. Phys.* 40 4850, which is incorporated herein by reference for all purposes). One embodiment of the invention includes exposing the substrate film to at least one of an anneal and irradiation with ions to aid in creation of the ohmic contacts. In one embodiment, the substrate film is irradiated in at least the areas where the contact pins make contact with the substrate film. This may include specific contact point irradiation, that is, coinciding with the contact points only and/or on slight larger areas than the contact points centered on the contact areas. In another implementation of this embodiment, a grid pattern of light, where the illuminated grid on the substrate includes the contact pin areas on the substrate, is used. In another embodiment, the substrate film is irradiated substantially across its surface so that selective irradiation at the contact pin's point of contact is not necessary.

Embodiments of the invention are meant to include combinations of the above methods of forming ohmic contacts, that is, particular materials as part of the contact pins to make ohmic contact at or near the plating potential, applying a break down voltage, exposing the substrate film to high intensity light, and preconditioning the film's physical characteristics toward better ohmic contact.

Embodiments of the invention also include contacting the underlying conductive layer, the layer under the substrate to which ohmic contacts are made, at the periphery, that is, voltage is applied to the periphery of the underlying conductive layer as well as via ohmic contacts through the substrate film.

After the electrodeposition on the substrate film, the contact pins are removed. By virtue of the pins presence during electrodeposition, the pins block electrodeposition on the substrate film at the locations of the contact pins. Therefore when the pins are removed, voids remain in the newly deposited layer.

Figure 6A:
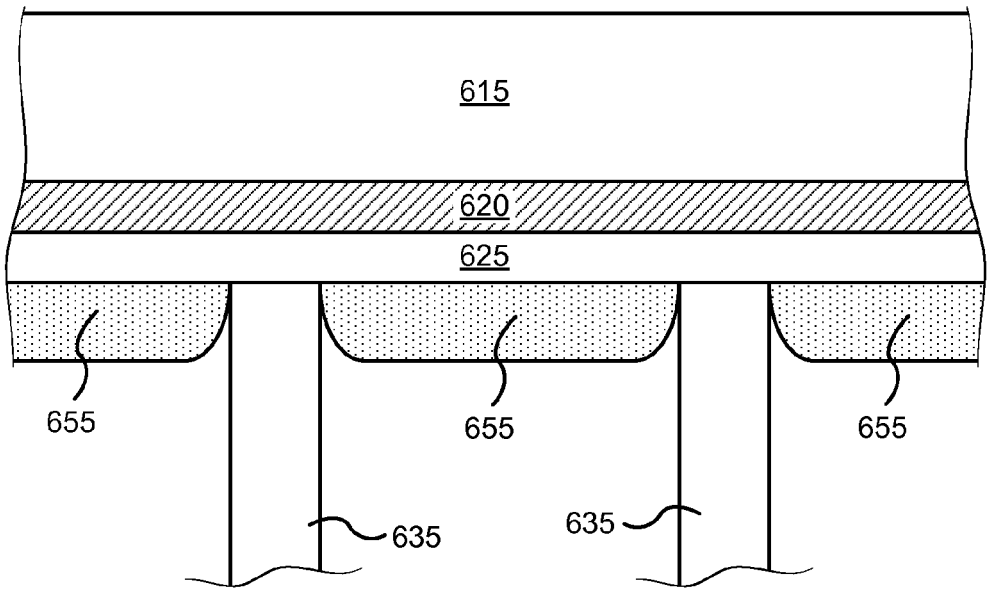
FIGS. 6A and 6B depict cross-sections of a stack formed using methods and apparatus in accord with embodiments of the invention.
Figure 6B:
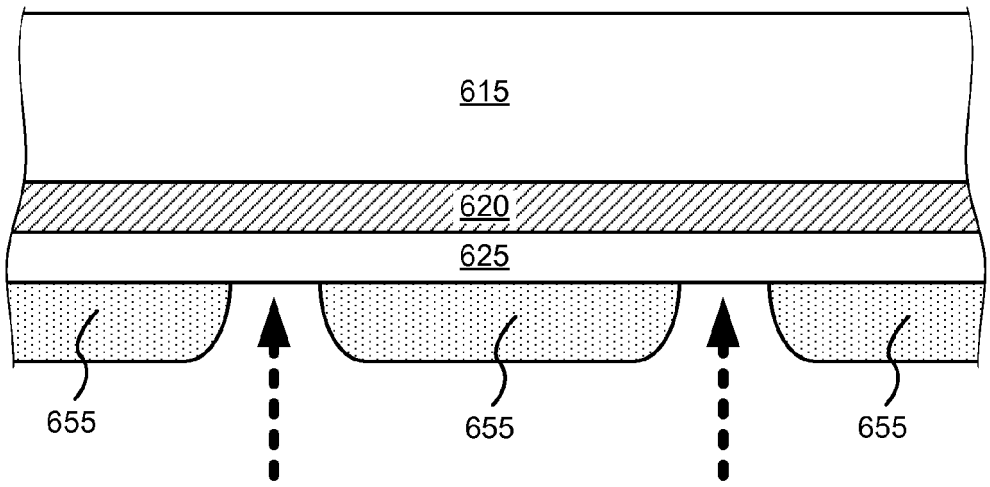

FIG. 6A depicts a cross-section of a portion of a stack, which includes a glass layer, 615, that is coated with a TCO, 620, and on TCO 620 is a CdS layer, 625. Contact pins, 635, are in contact with the CdS substrate film, 625, and a newly deposited CdTe layer, 655, is on top of CdS layer 625. Note that where the contact pins make contact with CdS layer 625, CdTe 655 was blocked from deposition. FIG. 6B shows the result of this deposition, when contact pins 635 are disengaged from substrate film 625. There are voids or holes in newly deposited CdTe layer 655. Thus, the areas where the contact pins make contact with the substrate do not receive any deposition on the substrate and this area is lost for photoelectrical generation. More importantly, these holes must be filled with an insulating material otherwise subsequent deposition of, for example, a back contact layer using, for example, sputtering or electrodeposition of copper, nickel, graphite, tin and/or other metals, alloys and composites would create short circuits in the device, that is, direct electrical communication between the conductive electrode layers of the device stack.

Figure 6C:
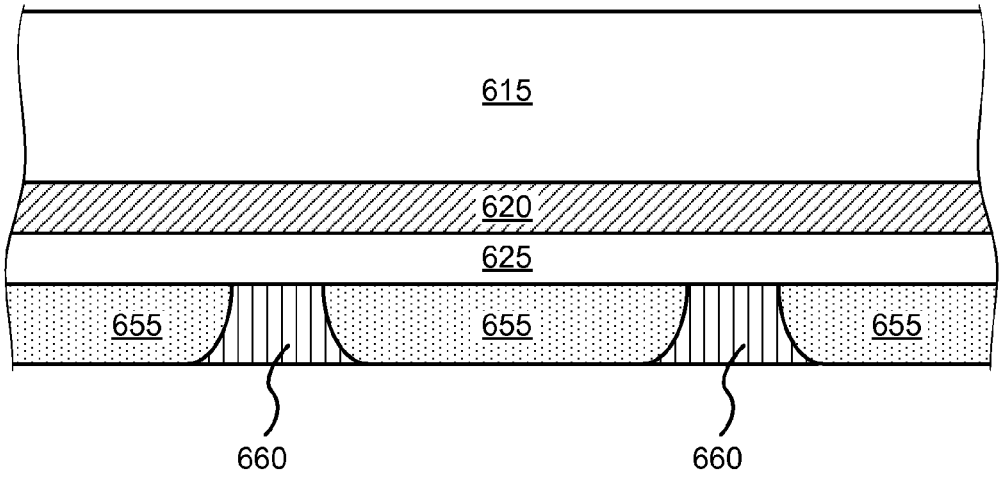
FIGS. 6C and 6D depict cross-sections of stacks formed using methods and apparatus in accord with embodiments of the invention.

FIG. 6C depicts the device stack of FIG. 6B after filling the holes with an insulating material. This insulating material is deposited by at least one of spraying, spin coating, evaporation, drop casting, liquid dispense (for example employing ink jet technology), atomic layer deposition (ALD), chemical deposition and the like. Thus, one embodiment is a method of electrodeposition as described above, further including: (c) disengaging contact between the plurality of contact pins and the substrate film; and (d) filling the holes in the material thus formed with an insulating material. Suitable materials for the insulating material include at least one of a negative photoresist, a positive photoresist, and the like. Photoresists are well suited for this filling operation because adjoining layers, for example depending on their opacity, can be used as masks for selective development of the photoresist in the holes versus on the field region. Using such selective development allows for corresponding selective removal of the resist from the field region and thus leaving plugs of the photoresist in the holes.

Figure 6D:
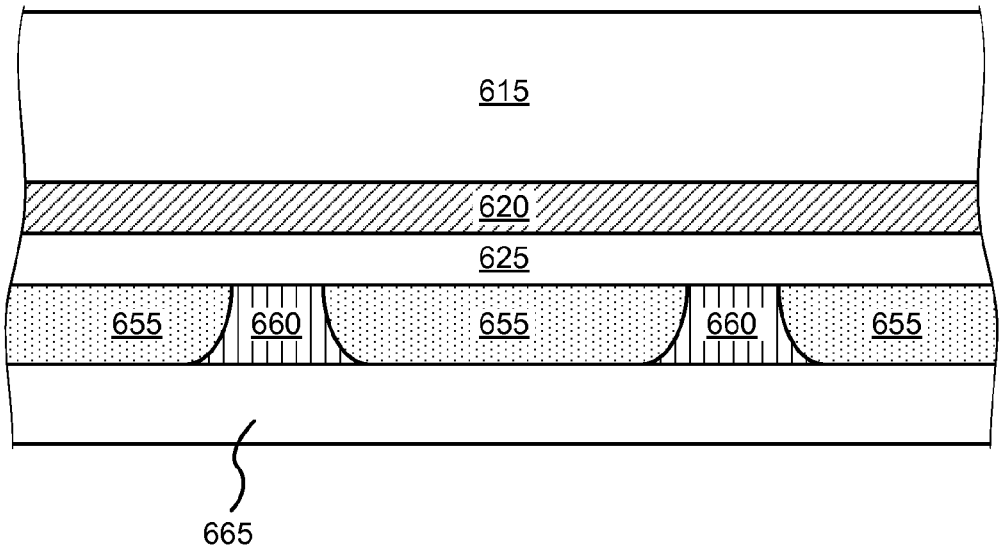

After the holes are filled with the insulating material, subsequent layers can be deposited, as depicted in FIG. 6D, where layer 665, for example a back contact layer, is deposited. In one embodiment, the insulating material is compatible with an anneal of the stack after the holes are filled. In another embodiment, the stack is annealed prior to filling the holes.

Methods of the invention can be used for depositing more than one material layer prior to filling with insulating material. Another embodiment is a method of electrodeposition as described above, further including: (c) electrodepositing a second material onto the (first) material, without first disengaging contact between the plurality of contact pins and the substrate film; (d) withdrawing the plurality of contact pins from the material and the second material; and (e) filling the holes in the (first) material and the second material thus formed with an insulating material. Insulating materials as described above for hole filling are suitable for hole filling in this method as well.

Some methods of the invention obviate the need to fill holes created in a newly electrodeposited layer resulting from electrodeposition followed by disengaging the contact pins from the substrate. One embodiment is an electrodeposition method as described above, where holes are exposed upon disengagement of the contact pins and the substrate, further including arranging the plurality of contact pins so that the areas where each of the plurality of contact pins make contact with the substrate film substantially coincide with one or more laser scribes that will be carried out during formation of one or more photovoltaic cells which include the substrate film. In one example, material (for example CdTe) is removed using laser ablation from certain regions in order to make interconnects and isolation trenches for creation of solar cells in a grid. If the contact probes are placed in a manner such that they are coincident with the areas that would be removed eventually for interconnecting and/or isolating individual cells, then the lack of deposition in the areas where the contact pins leave voids does not result in any additional loss of photoelectrically active area. That is, using this method, there is no need to fill the holes, but rather make them part of, for example, a planned isolation trench or interconnect scheme.

Embodiments described above include scenarios where the contact pins touch a substrate film in order to make ohmic contacts to an underlying conductive layer. It is important to note that transparent conductive oxides, for example, have an inherent sheet resistance, therefore methods of the invention are well suited for laying down, for example, cadmium sulfide layers on a TCO. Even though currently there are more cost effective methods of depositing CdS on a TCO, for example by chemical deposition, these homogeneous nucleation chemical depositions create large waste streams. Electrodeposition methods described herein make less waste, and therefore it is contemplated that due to the true cost of current homogeneous nucleation chemical depositions, methods of the invention may replace them. One embodiment is a method of electrodeposition, including: (a) establishing a plurality of ohmic contacts to a transparent conductive oxide film using a plurality of contact pins, said plurality of contact pins electrically isolated from a counter electrode; and (b) electrodepositing a material from an electrolyte onto the transparent conductive oxide film.

Although the foregoing invention has been described in some detail for purposes of clarity of understanding, it will be apparent that certain changes and modifications may be practiced within the scope of the appended claims. Therefore, the present embodiments are to be considered as illustrative and not restrictive and the invention is not to be limited to the details given herein, but may be modified within the scope and equivalents of the appended claims.

What is claimed is:

1. A method of electrodeposition, comprising:

(a) establishing a plurality of ohmic contacts from a plurality of contacts pins to an underlying conductive layer through a semiconductor substrate film so as to cause negligible resistance from each contact pin, through the semiconductor substrate film, to the underlying conductive layer, said plurality of contact pins electrically isolated from a counter electrode;

(b) electrodepositing a material from an electrolyte onto the substrate film to form a deposited film while the plurality of ohmic contacts are established;

(c) withdrawing the plurality of contact pins from the deposited film to form a plurality of holes in the deposited film that are left in a plurality of positions from which the plurality of contact pins are withdrawn;

(d) completely filling a portion or all of a plurality of holes, which were formed in the deposited film by the plurality of contact pins during the electrodepositing, with an insulating material to form a plurality of filled holes; and (e) forming a back contact layer over the deposited film to form at least one photovoltaic cell, wherein the insulation material remains in the filled holes after the back contact layer is formed.

2. The method of claim 1, wherein the underlying conductive layer comprises a sheet resistance of between about 2 ohms per square and about 20 ohms per square.

3. The method of claim 1, wherein the semiconductor substrate film comprises cadmium sulfide.

4. The method of claim 3, wherein the contact pins comprise at least one of indium, gallium, aluminum or zinc.

5. The method of claim 3, wherein the breakdown voltage for establishing each of the plurality of ohmic contacts is between about 0.5 volts and about 10 volts.

6. The method of claim 3, wherein the breakdown voltage for establishing each of the plurality of ohmic contacts is between about 1 volt and about 5 volts.

7. The method of claim 1, wherein the insulating material comprises at least one of a positive photoresist and a negative photoresist.

8. The method of claim 1, wherein each ohmic contact is established prior to exposure of the semiconductor substrate film to the electrolyte.

9. The method of claim 1, wherein each ohmic contact is established after exposure of the semiconductor substrate film to the electrolyte.

10. The method of claim 1, wherein the semiconductor substrate film was formed over the underlying conductive layer and together comprise a plurality of at least partially formed photovoltaic cells, the method further comprising arranging the plurality of contact pins to contact a plurality of areas that are inside a plurality of areas of the plurality of at least partially formed photovoltaic cells.

11. The method of claim 1, further comprising verifying the connectivity of one or more of the plurality of contact pins after engagement with the semiconductor substrate film.

12. The method of claim 11, wherein verifying the connectivity of one or more of the plurality of contact pins comprises using a probe card and a switching matrix.

13. The method of claim 1, wherein the substrate film is on a curved surface.

14. A method of electrodeposition, comprising:

(a) establishing a plurality of ohmic contacts from each of a plurality of conductive contact pins, through a CdS film to an underlying conductive layer, said plurality of contact pins electrically isolated from a counter electrode so as to cause negligible resistance from each contact pin, through the CdS film, to the underlying conductive layer; and (b) electrodepositing a material from an electrolyte onto the CdS film in response to establishing the plurality of ohmic contacts to form a deposited film while the plurality of ohmic contacts are established;

(c) disengaging contact between the plurality of contact pins and the CdS film to form a plurality of holes in the deposited films that are left in a plurality of positions from which the plurality of contact pins are withdrawn;

(d) completely filling a portion or all of a plurality of holes in the deposited film, which holes were caused by the contact pins during electrodeposition of such deposited film, with an insulating material to form a plurality of filled holes; and (e) forming a back contact layer over the deposited film to form at least one photovoltaic cell, wherein the insulating material remains in the filled holes after the back contact layer is formed, wherein (a) comprises at least one of applying a breakdown voltage to each of the plurality of contact pins.

15. The method of claim 14, wherein the underlying conductive layer is a transparent conducting oxide.

16. The method of claim 15, wherein the CdS film is between about 0.01 μm and about 10 μm thick.

17. The method of claim 14, wherein the insulating material comprises at least one of a positive photoresist and a negative photoresist.

18. The method of claim 14, wherein the CdS film is on a curved surface.

19. The method of claim 1, wherein the CdS film, upon which the material is electrodeposited, is an n- or p-type semiconductor material.

20. The method of claim 1, wherein the CdS film, upon which the material is electrodeposited, is a window layer of a photovoltaic device.

21. The method of claim 20, wherein the deposited film, is an absorber layer of the photovoltaic device.

22. The method of claim 1, wherein the contact pins are positioned in a photoelectrically active area of a photovoltaic cell.

23. A method for forming a photovoltaic cell, comprising:

providing a partially formed photovoltaic cell comprising a top contact layer formed on a top encapsulation layer and a window layer formed over the top contact layer;

establishing a plurality of ohmic contacts with the top contact layer via the window layer using a plurality of contact pins so as to cause negligible resistance from each contact pin, through the window layer, to the top contact layer, said plurality of contact pins electrically isolated from a counter electrode;

electrodepositing an absorber layer from an electrolyte onto the window layer during which a plurality of voids are formed in the absorber layer at a plurality of positions corresponding to the plurality of contact pins while the plurality of ohmic contacts are established;

disengaging the contact pins from the window layer and the electrodeposited absorber layer to form a plurality of voids in the absorber layer, which voids are left in a plurality of positions from which the plurality of contact pins are withdrawn;

selectively and completely filling the voids in the absorber layer with an insulation material to form a plurality of filled voids;

forming a back contact layer over the absorber layer to form a photovoltaic cell, wherein the insulation material remains in the filled voids after the back contact layer is formed.

24. The method of claim 23, wherein the top contact layer comprises a conductive material, the window layer comprises a semiconductive, insulative material, and the absorber material comprises a semiconductive material, wherein the partially formed photovoltaic cell further comprising a buffer layer, which is comprised of a semiconductive, insulative material, between the top layer and window layer.

25. The method of claim 24, wherein the buffer layer comprises $SnO_2$, the window layer comprises CdS, and the absorber layer comprises CdTe.

26. The method of claim 24, wherein electrodepositing is performed by establishing a plurality of ohmic contacts from each of the plurality of contact pins, through the window layer, to the top contact layer by individually applying a breakdown voltage to each of the plurality of contact pins.

27. The method of claim 26, wherein each breakdown voltage of each of the plurality of contact pins is individually selected so that establishing the plurality of ohmic contacts results in uniform deposition of the absorber layer across the window layer during the electrodeposition.

* * * * *